US011578504B2

(12) United States Patent
Mallouk

(10) Patent No.: US 11,578,504 B2
(45) Date of Patent: Feb. 14, 2023

(54) SECURITY LOCKING SYSTEM

(71) Applicant: Yves Mallouk, Le Tréport (FR)

(72) Inventor: Yves Mallouk, Le Tréport (FR)

( * ) Notice: Subject to any disclaimer, the term of this patent is extended or adjusted under 35 U.S.C. 154(b) by 97 days.

(21) Appl. No.: 16/500,300

(22) PCT Filed: Apr. 4, 2018

(86) PCT No.: PCT/IB2018/052330
§ 371 (c)(1),
(2) Date: Oct. 2, 2019

(87) PCT Pub. No.: WO2018/185681
PCT Pub. Date: Oct. 11, 2018

(65) Prior Publication Data

US 2020/0071954 A1 Mar. 5, 2020

(30) Foreign Application Priority Data

Apr. 7, 2017 (FR) ..... 1770357

(51) Int. Cl.
*E05B 29/00* (2006.01)
*E05B 27/00* (2006.01)
(Continued)

(52) U.S. Cl.
CPC ..... *E05B 29/0026* (2013.01); *E05B 17/2023* (2013.01); *E05B 19/0058* (2013.01);
(Continued)

(58) Field of Classification Search
CPC ..... E05B 17/2023; E05B 19/0017; E05B 19/0052; E05B 19/0058; E05B 19/0064;
(Continued)

(56) References Cited

U.S. PATENT DOCUMENTS 1,390,222 A * 9/1921 Wise ..... E05B 67/22 70/38 C
2,772,558 A * 12/1956 Gardner ..... E05B 29/0006 70/264

(Continued)

FOREIGN PATENT DOCUMENTS

DE 2532076 A1 7/1976
DE 29513123 U1 1/1996
GB 2142967 A 1/1985

OTHER PUBLICATIONS

International Search Report for PCT/IB2018/052330 dated Jun. 15, 2018.

(Continued)

*Primary Examiner* — Christopher J Boswell
(74) *Attorney, Agent, or Firm* — Thomas Horstemeyer, LLP

(57) ABSTRACT

The present invention relates to a security locking system of the type comprising a cylinder (3) provided with a set of pistons (8) that are able to be positioned by elastic means on the impression formed in the edge (7*b*, 7*c*) of a control key (7) perpendicularly to the direction in which said key (7) is introduced into the cylinder (3), these pistons (8) being able to take up two positions, namely a position retracted into the cylinder (3) when the key (7) is introduced into the latter and an extended position when the key (7) is withdrawn there from. This system is characterized in that:—the cylinder is made up of a locking block (3) of parallelepipedal shape that is able to be received in a receiving block (5),—it comprises locking means which are activated when the locking block (3) is introduced into the receiving block (5).

14 Claims, 5 Drawing Sheets

(51) Int. Cl.

| | |
|---|---|
| ***E05B 19/00*** | (2006.01) |
| ***E05B 15/12*** | (2006.01) |
| *E05B 65/00* | (2006.01) |
| *E05B 65/08* | (2006.01) |
| *E05B 67/22* | (2006.01) |
| *E05B 67/36* | (2006.01) |

(52) U.S. Cl.
CPC ..... *E05B 27/0028* (2013.01); *E05B 29/0006* (2013.01); *E05B 65/0067* (2013.01); *E05B 65/0876* (2013.01); *E05B 65/0894* (2013.01); *E05B 67/22* (2013.01); *E05B 67/36* (2013.01)

(58) Field of Classification Search
CPC ..... E05B 19/046; E05B 19/18; E05B 27/00; E05B 27/0003; E05B 27/0007; E05B 27/0028; E05B 27/02; E05B 29/00; E05B 29/0006; E05B 29/0026; E05B 29/0066; E05B 65/0067; E05B 65/0876; E05B 65/0894; E05B 67/22; E05B 67/24; E05B 67/36
See application file for complete search history.

(56) References Cited

U.S. PATENT DOCUMENTS 4,126,025 A * 11/1978 Miyamae ..... E05B 19/00 70/360
4,149,394 A * 4/1979 Sornes ..... E05B 35/007 70/352
4,630,457 A 12/1986 Kincaid et al.
5,146,770 A * 9/1992 Yun-Sheng ..... E05B 35/007 70/38 C
5,181,407 A * 1/1993 Wu ..... E05B 35/007 70/276
5,212,974 A * 5/1993 Shen ..... E05B 29/0006 70/352
6,314,775 B2 * 11/2001 Schwab ..... E05B 19/046 70/408
6,595,032 B2 * 7/2003 Lin ..... B60R 25/066 70/134
6,761,052 B2 * 7/2004 Buschmann ..... E05B 13/105 292/DIG. 37
7,716,960 B2 * 5/2010 Tamezane ..... E05B 29/0006 70/361
7,793,528 B2 * 9/2010 Maples ..... E05B 35/007 70/352
7,930,916 B2 * 4/2011 Tamezane ..... E05B 27/0028 70/222
7,930,917 B2 * 4/2011 Katagiri ..... E05B 29/0006 70/379 R
8,042,367 B2 * 10/2011 Tamezane ..... B60R 25/22 70/352
8,336,346 B2 * 12/2012 Mah ..... E05B 27/0028 70/38 B
8,820,127 B2 * 9/2014 Avganim ..... E05B 27/0028 70/375
2020/0332567 A1 * 10/2020 Wang ..... E05B 29/0066

OTHER PUBLICATIONS

Written Opinion of the International Searching Authority for PCT/IB2018/052330 dated Jun. 21, 2018.

* cited by examiner

SECURITY LOCKING SYSTEM

CROSS-REFERENCE TO RELATED APPLICATIONS

This application is a § 371 national phase application of PCT/IB2018/052330 filed Apr. 4, 2018 entitled "SECURITY LOCKING SYSTEM," which claims the benefit of and priority to France Patent Application No. 1770357 filed Apr. 7, 2017, published as France Patent Application No. FR3056243, the contents of which being incorporated by reference in their entireties herein.

BACKGROUND

Many cylinder lock designs are known which essentially comprise a removable barrel or rotor, which is rotatably mounted in a stator. A bit is secured to the rotor and its rotation controls the opening/closing mechanism of the lock. The rotor has a series of pistons, each of which is solicited by a spring that applies them, when a key is inserted into the lock, against the edge of the key, which, for this purpose, has a profile specific to each lock.

BRIEF SUMMARY OF THE INVENTION

The present invention relates to a cylinder-type security locking system, which is of particularly simple construction and does not require the locking thereof to make use of a rotation of the control key.

Many cylinder lock designs are known which essentially comprise a removable barrel, or rotor, which is rotatably mounted in a stator. A bit is secured to the rotor and its rotation controls the opening/closing mechanism of the lock. The rotor has a series of pistons, each of which is solicited by a spring that applies them, when a key is inserted into the lock, against the edge of the key, which, for this purpose, has a profile specific to each lock.

The keys of this type have barrels which are cylindrical in shape so that, for a given piston arrangement, they are usually of a relatively large thickness which is sometimes incompatible with certain applications. The present invention proposes to reduce the thickness of such locks. Furthermore, usually the two lateral faces of the admission light of the key are of a shape that is complementary to the imprint of the lateral surface of the two sides of the key so as to exert a first control of the correct shape thereof. However, this zone does not have a sufficient depth so that it is able to prevent the introduction of tools into the lock making it possible to realize the lock picking. The present invention also proposes to solve this difficulty.

Finally, in security systems of the prior art which, for example, ensure the locking of a series of lockers, which are available to multiple users, each of which is constrained to use the assigned locker and which corresponds to the key/barrel adequacy. Therefore, the user does not have the option of selecting the appropriate locker. The object of the present invention is also to provide a security locking system that allows the user to choose from a series of free boxes that he wishes to use and change according to its needs.

The present invention thus concerns a security locking system of the type comprising a cylinder provided with a set of pistons that are able to be positioned by elastic means on the impression formed in the edge of a control key, perpendicularly to the direction in which said key into the cylinder, said pistons being able to occupy two positions, namely a retracted position inside the cylinder when the key is inserted therein and an extended position when the key is extracted therefrom. This locking system is characterized in that the cylinder is made up of a locking block of parallelepipedal shape that is able to be received in a receiving block, and it comprises locking means, which are activated when the locking block is introduced into the receiving block. Preferably, the locking block comprises means capable of blocking it in the receiving block when the pistons are in the retracted position.

According to the invention, the receiving block will preferably be of parallelepipedal shape.

Furthermore, the locking block can comprise a guide and control block comprising an intake duct for the key, at least one of the lateral walls of which will be of a shape complementary to that of one of the lateral flanks of the key. Preferably, the intake duct will have a length which will be at least equal to half the height of the lateral flanks of the key. The means for maintaining can consist of a spring blades, one end of which will be fixed on the receiving block and the other end of which will comprise a hook capable of cooperating with a notch of the locking block in order to maintain the latter with the receiving block.

The key may be provided with means capable, by slight rotation, to releasing the locking block from the means for maintaining. The key can thus be provided with a stud able, during said slight rotation, to push the hook so as to release the locking block.

In one embodiment of the present invention, the locking means can be constituted by the locking block itself.

Furthermore, the receiving block may be constituted by the body of a padlock, and may also be integral with the body of a computer.

In an alternative embodiment, at least one of the lateral faces of the locking block will comprise a profile of specific shape and the internal face of the receiving block will comprise a profile of complementary shape.

Finally, the key may be provided with a head inside which a slide will be slidably mounted, one part of which will project from the head on its front so as to be able to be supported on the locking block when the key will be engaged in the latter.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

Hereinafter, by way of no limiting example, embodiments of the present invention will be described with reference to the appended drawing in which.

DETAILED DESCRIPTION

FIGS. 1 to 4 show a security lock 1 implementing the operating principle of the security locking system according to the invention and which comprises a locking block 3 of parallelepipedal shape, a receiving block 5 of complementary shape, and a flat control key 7 of the conventional type for this type of lock.

Figure 1:
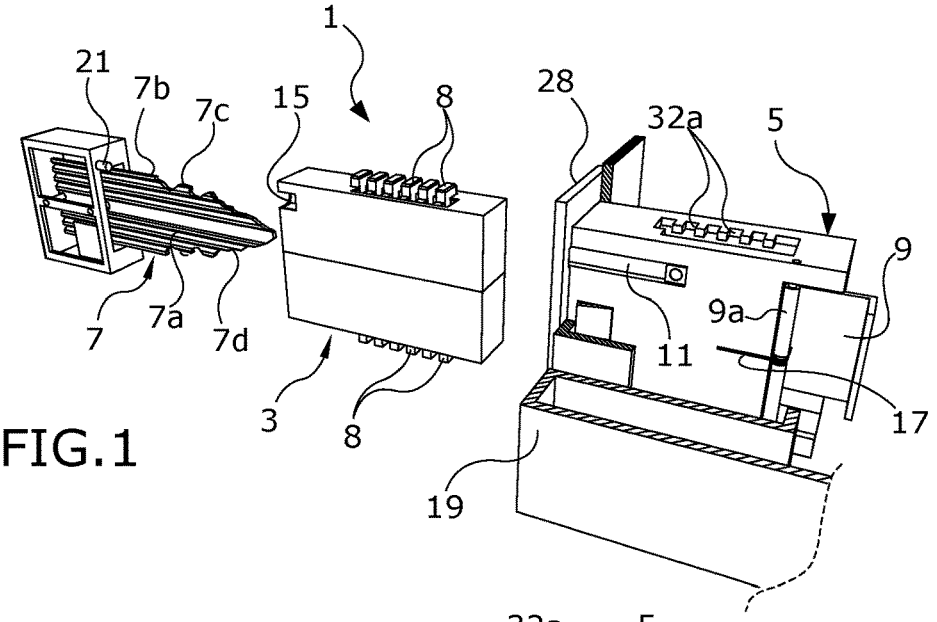
FIG. 1 is an exploded perspective view of a security locking system according to the invention shown in the unlocking position.
Figure 2:
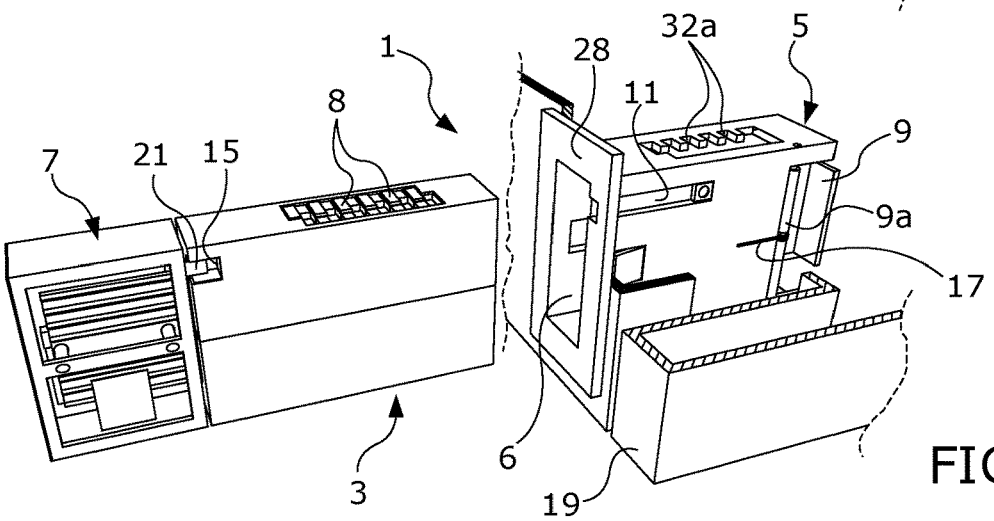
FIG. 2 is an exploded perspective view represented under another angle of the security locking system of FIG. 1 in the position of insertion of the key into a locking block.
Figure 3:
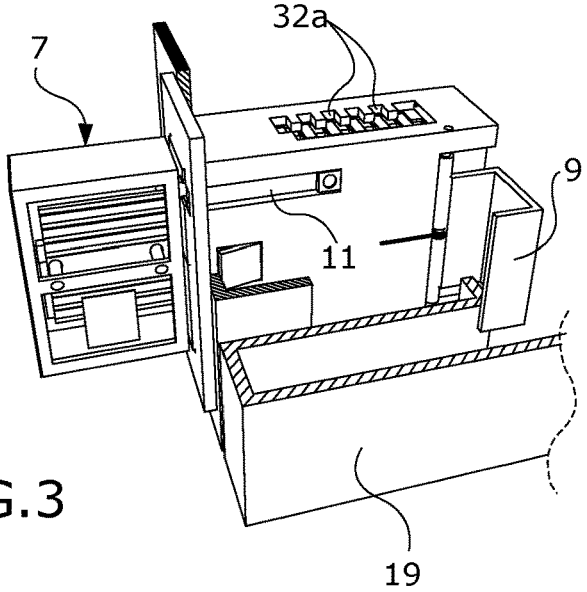
FIG. 3 is a perspective view of the security locking system of FIG. 2 shown in the locking position.

The locking block 3 is provided with a mechanism that will be described in detail below, and which comprises a series of 12 pistons 8 which, when the key 7 is not introduced into said locking block, as shown in FIG. 1, are in the extended position and, when the key 7 is inserted therein, as shown in FIGS. 2 and 3, are in the retracted position. The receiving block 5 comprises an inlet face 28 provided with an orifice 6 of the same shape and dimensions as the cross section of the locking block 3, so that when the key 7 is inserted into the locking block 3 and, accordingly, the pistons 8 are retracted, it is able to receive the locking block 3 as well as shown in FIG. 3.

The key 7 is of the flat type, that is to say that, in a conventional manner and as shown in FIG. 1, it comprises two lateral flanks 7*a* and 7*b*, and two upper and lower edges 7*c* and 7*d*. The lateral flanks 7*a* and 7*b* and the edges 7*c* and 7*d* are machined or molded into profiles, which are specific to each key.

The receiving block 5 comprises a means for maintaining capable of securing the locking block 3 once it has been placed in the latter. In the present embodiment, these means for maintaining are constituted, as shown in FIGS. 1 and 2, by a spring blades 11 which is fixed at one of its ends to the receiving block 5 and which, at its other end is folded so as to form a hook 11*a* which is placed in a notch 15 of the locking block 3 and which thus ensures the retaining of the latter and prevents its removal from the receiving block 5.

When the key 7 of the locking block 3 is removed, the hook 11*a*, prevents the output of the latter from the receiving block 5 once the key has been removed, the pistons 8 pass into the extended position and ensure the locking of the locking block 3 in the receiving block 5.

It can be seen, as shown in FIG. 3, that when the locking block 3 takes place in the receiving block 5 it actuates a mechanism, referred to as the locking mechanism which, in the present embodiment, consists of a rotary bolt 9 which, is pushed back by the locking block 3 when it is installed, pivots under this action about an axis 9*a* against the action of a bending spring 17 to lock, for example, locker 19.

Figure 4:
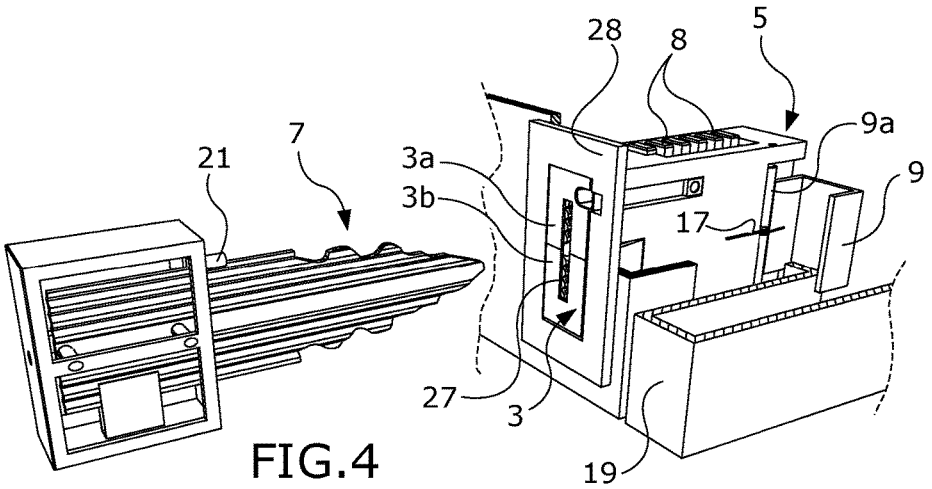
FIG. 4 is a perspective view of the security locking system of the preceding figures represented in the locking position of a rack, the key being removed from the locking block.

The locking being carried out; the user can then remove its key 7 from the locking block 3, as shown in FIG. 4, which has the effect of releasing the pistons 8 which, under the action of elastic means, come into an extended position.

Figure 5A:
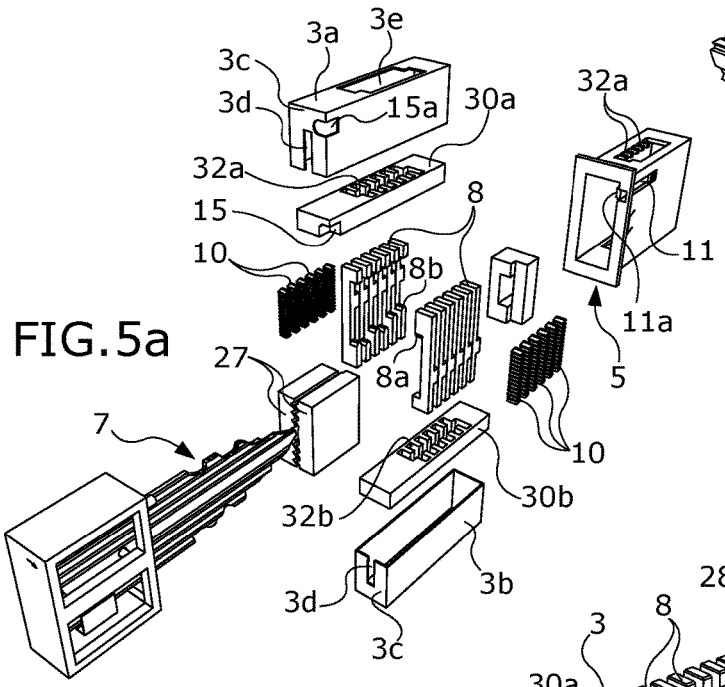
FIG. 5*a* is an exploded view of the key and elements constituting a locking block of the security locking system shown in the preceding figures.
Figure 5B:
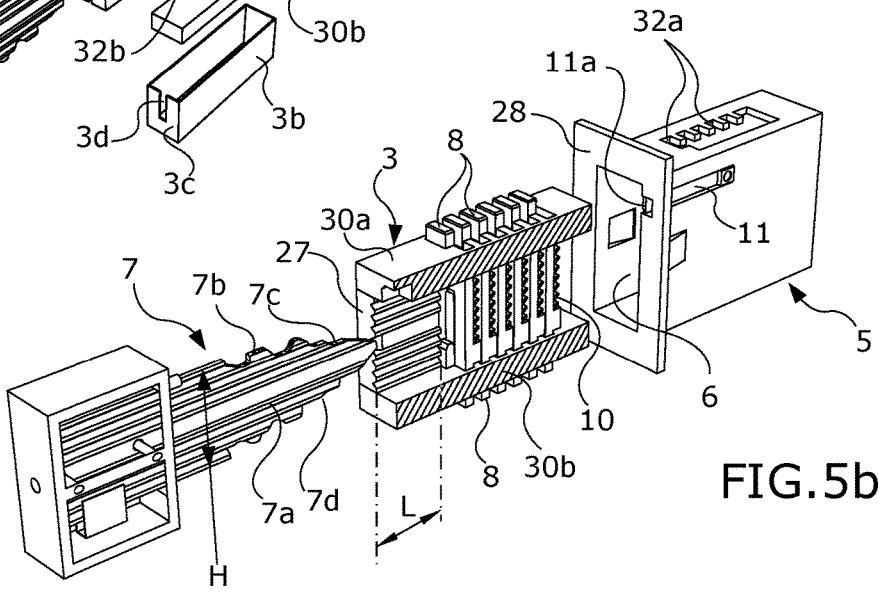
FIG. 5*b* is a perspective view and vertical cross-section of a locking block.

FIGS. 5*a* and 5*b* show an example of an internal mechanism to the locking block 3 which allows the pistons 8, as well as specified above, to be in the extended position when the key 7 is not in place in the locking block 3 and to be in the retracted position when this key is in place therein.

Figure 6:
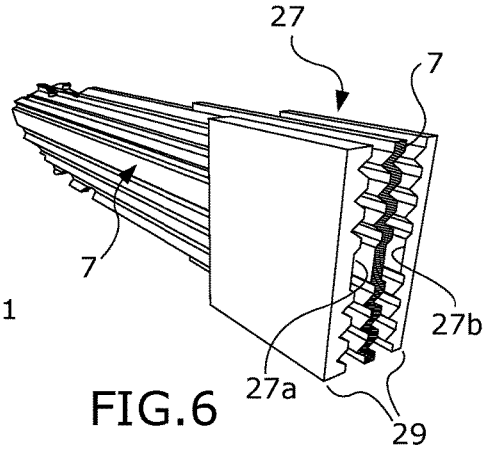
FIG. 6 is a perspective view of a guide and control block according to an embodiment of the invention.

In the present embodiment, the locking block 3 of parallelepipedal shape is made as two rectangular cuvettes 3*a* and 3*b* that are attached by means (not shown in the drawing). When the rectangular cuvettes are assembled, one of the vertical faces on the drawing forms an entry face 3*c* which is pierced with a window 15*a* which allows the reception of the hook 11*a* and an admission window 3*d* which gives access to a guide block 27 and for controlling the key 7 comprising an inlet conduit 29, two opposite faces 27*a* and 27*b* having cavities respectively complementary to those of the two lateral flanks 7*a* and 7*b* of the key, as shown in FIGS. 5*b* and 6.

Downstream of the guide block and control 27 are arranged two rows of pistons 8 which are provided with sensors for engaging the respective profiles upper 7*c* and lower 7*d* of the key 7. A row 8 comprises sensor 8*b* capable of coming into contact with the upper profile 7*c* of the key and the other row comprises sensors 8*a* capable of coming into contact with the lower profile 7*d* thereof.

The upper and lower parts of each of the pistons 8 respectively take place in recesses 32*a* and 32*b* made in upper and lower guide plates 30*a* and lower 30*b* which are respectively arranged in the upper and lower part of the locking block 3. Openings 3*e* are provided in the upper and lower parts of the rectangular cuvettes 3*a* and 3*b* so as to allow the ends of the pistons 8 to leave the locking block 3 when the key 7 is not engaged therein.

Each of the pistons 8 is solicited by a spring 10 which, in the absence of the key 7, brings it into the extended position as shown in FIGS. 1, 4, and 5*b*.

The present invention is particularly advantageous in that it makes it possible to produce a guide and control block 27 which is of a considerable length L for this type of lock, that is at least equal to half the height H of the lateral imprint of the key, which is of a nature to increase the security of the latter by preventing the introduction of instruments intended to intervene on the pistons 8.

The operation of the lock according to the invention is thus effected as described below.

Initially the user has a key 7 which is inserted into a locking block 3 and wishes for example realizing locking a locker 19 in which it desires to safety effects. Unlike prior art locking devices, the user has the option of choosing the locker which is suitable for it from the free boxes of a set of lockers since the latter will then be free of any locking block.

The key 7 of the user being inserted into the locking block 3, as well as shown in FIG. 2, the pistons 8 of the latter are therefore in the retracted position and the user can then insert the locking block 3 into the receiving block 5 of the locker it will have chosen. In doing so, the locking block 3 pushes the bolt 9 against the force exerted by the bolt spring 17 and the bolt then locks the locker 19, as shown in FIG. 3.

The user then removes his key 7 and, during this withdrawal movement, the locking block 3 is restraint in the receiving block 5 by the hook 11*a,* and the pistons 8 move to the extended position as the key is extracted, which locks the locking block 3 inside the receiving block 5 and, consequently, ensures the locking of the locker 19, as shown in FIG. 4

Figure 7:
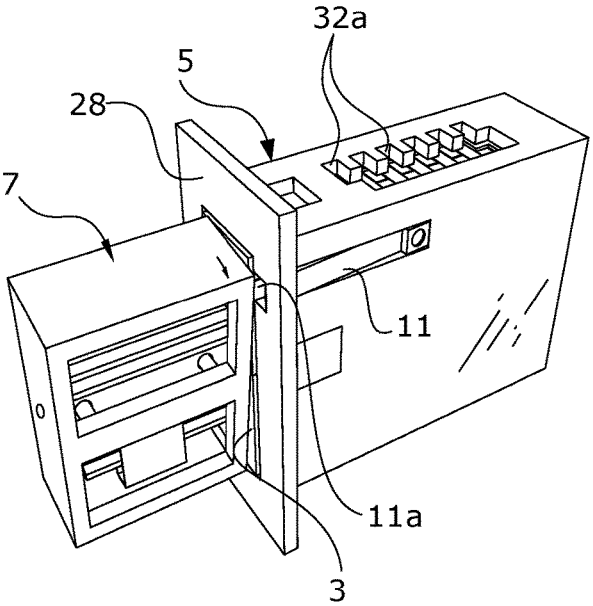
FIG. 7 is a perspective view of the security locking system shown in the preceding figures in the locking position, the key being rotated in a release position thereof.

When the user wishes to recover its effects and release its locker, he introduces his key 7 into the locking block 3, which has the effect of passing the pistons 8 from the extended position to the retracted position, then it rotates slightly the means comprising the stud 21 the key 7 in the direction of the hands of a watch (arrow a), as well as shown in FIG. 7, which has the effect of allowing the stud 21 of the key 7 to push the hook 11*a* and the user when it exerts a tensile force on the key, to extract the locking block 3 from the receiving block 5, under the effect of the pressure of the springs 10 which push the pistons 8 to take place on the reliefs 7*d* and 7*c* of the key.

When the locking block 3 is removed, the locking mechanism returns to its initial position and the bolt 9 thereof, under the action of the spring 17, returns to its initial position thus freeing the rack 19.

Figure 8A:
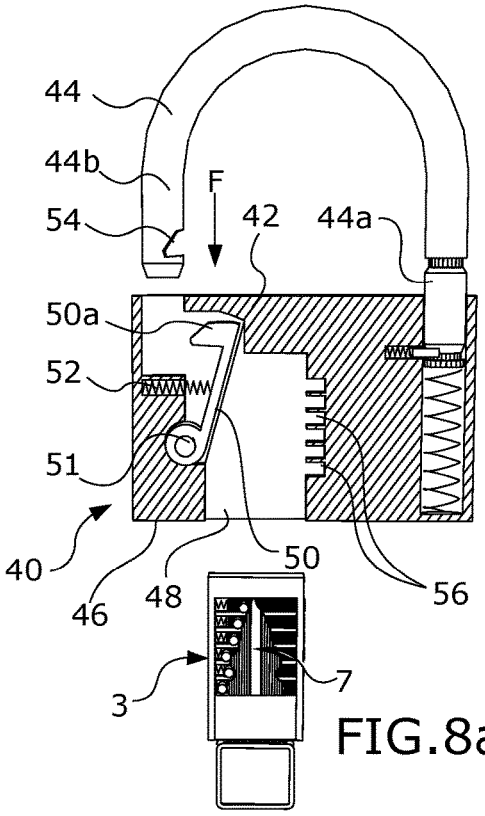
FIGS. 8*a* and 8*b* are views of an embodiment of the invention applied to a padlock, respectively in unlocked position and in locked position.
Figure 8B:
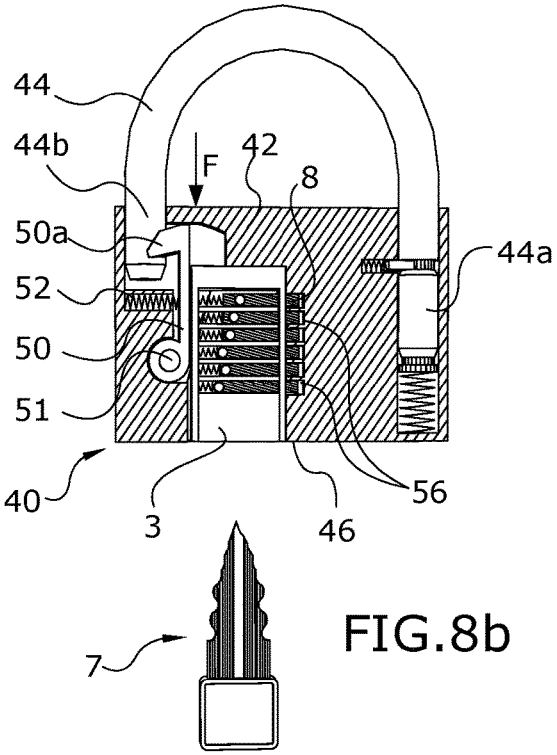

Of course, the security locking system according to the invention can be used with any other security device than a lock and can be used for example on a padlock, as shown in FIGS. 8*a* and 8*b*.

In these figures, a padlock 40 of the conventional type is shown in section, comprising a body 42 in which a locking ring 44 has a first end 44*a* which, in a known manner, is mounted both in rotation and sliding in the body 42. Thus, the locking ring is able to occupy two positions, namely an unlocking position in which its second end 44*b* is output from the body 42, as shown in FIG. 8*a*, and a locking position in which this second end 44*b* is locked in the body 42, as shown in FIG. 8*b*.

The locking of this padlock is obtained by means of a security locking system according to the invention.

For this purpose, the bottom 46 of this padlock is hollowed out with a parallelepipedal cavity 48 making it possible to receive a locking block 3, so that it thus constitutes a receiving block, for example of the type described above.

Furthermore, a locking lever 50 having a free end forms a hook 50*a* is rotatably mounted in the body 42 about an axis 51, at its other end in such a way, than in the absence of the locking block 3 therein, it extends into the cavity 48 under the action of a compression spring 52 and that, in the presence of the locking block 3, this lever is pushed back against the spring 52 and that its hook 50*a* is housed in a notch 54 made at the second end 44*b* of the locking ring 44. The part of the cavity 48 opposite the spring 52 is hollowed out of mini-cavities 56 each intended to receive one end of the pistons 8 of the locking block 3.

In order to lock the padlock 40, the control key 7 is introduced into the locking block 3, which has the effect of eclipsing the output part of the pistons 8, as shown in FIG. 8*a*. Then, the subassembly formed of the key 7 and the locking block 3 is introduced into the cavity 48 of the padlock, and thereby, the locking lever 50 is pushed back so that, if, at this moment, the locking ring has been pushed back in the direction of the arrow F , the hook 5*a* penetrates into the notch 54 of the locking ring 44. When the user removes the key 7 from the locking block 3 the ends of the pistons 8 then come to be housed in the mini-cavities 56, which ensures the locking of the padlock.

In order to unlock the latter, the user inserts his key 7 into the locking block 3, which has the effect of eclipsing the ends of the pistons 8, which releases the latter and the user can then withdraw the lock body from the padlock body, the assembly consisting of the key 7 and the locking block 3. The locking Lever 50, under the action of the spring 52 then emerges from the notch 54, thus freeing the locking ring 44 from the padlock.

The locking system according to the invention can be used for locking multiple security devices. It can thus, for example, be used for locking sliding leaves of a display case.

Figure 9A:
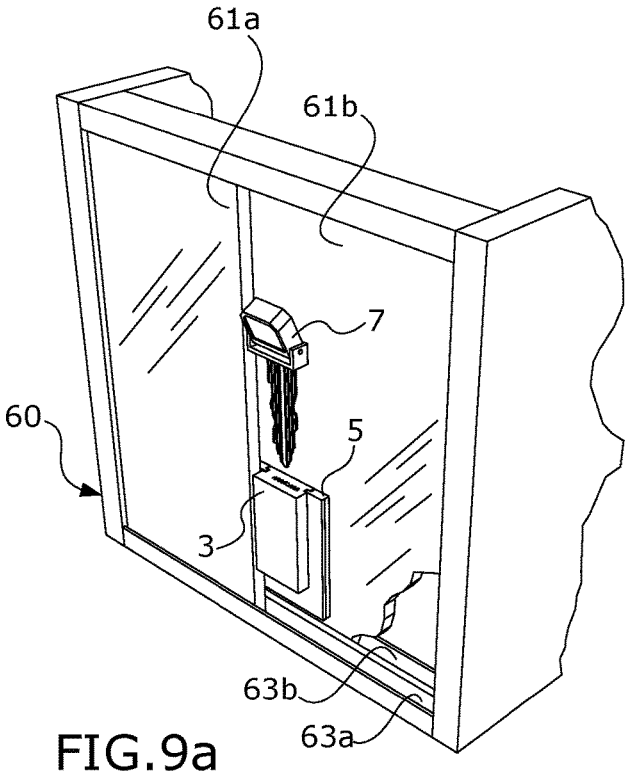
FIG. 9*a* is a schematic view of another embodiment of the invention applied to the locking of two sliding panels of a display case.
Figure 9B:
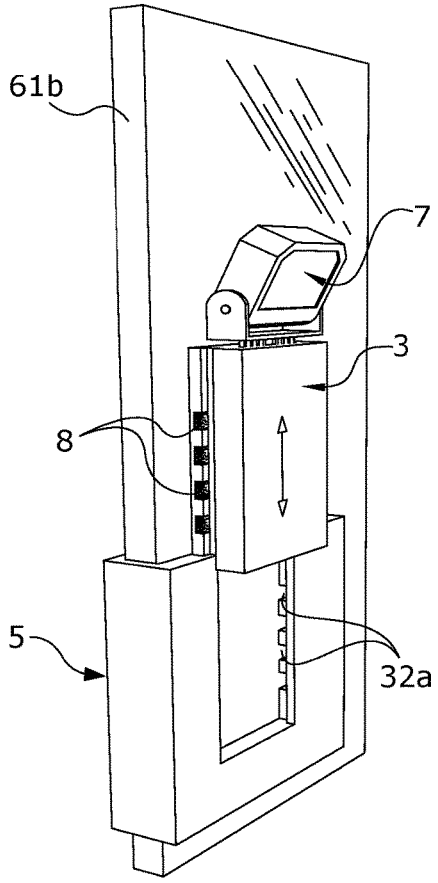
FIG. 9*b* is a perspective view of a detail of implementation of FIG. 9*a* in the unlock position.

FIGS. 9*a* and 9*b* show such an alternative embodiment of the invention. In these figures, a display case 60 is schematically represented which is closed by two glass panels 61*a* and 61*b* which are respectively mounted so as to slide in two parallel slides 63*a* and 63*b*. The closure of this display case is provided by a security locking system according to the invention. For this purpose, the panel 61*b* is secured by any suitable means such as screwing and/or gluing, a receiving block 5 which has recesses 32*a* which are arranged in such a way that they face the pistons 8 of a locking block 3 when the latter, as well as previously, will be introduced into the receiving block 5. The receiving block 5 has a thickness such that it can slide between the space existing between the two panels 61*a* and 61*b* so as not to interfere with their displacement, and the locking block 3 for its part is of a thickness such that when it is in place in the bollard receiving block 5 it abuts against the panel 61*a,* as well as shown in FIG. 9*a*.

When removing the key 7 of the locking block 3, the locking block is maintained in place under the pressure of a finger and the pistons 8 thereof penetrate the notches 32*a* and thus provide the securing of the locking block 3 with the receiving block 5. In this position, the locking block forms a stop which prevents the movement of the panel 61*a* to the left in FIG. 9*a* and that of the panel 61*b* to the right, so that the locking of the display case is ensured. The unlocking is, of course, as explained above.

Figure 10:
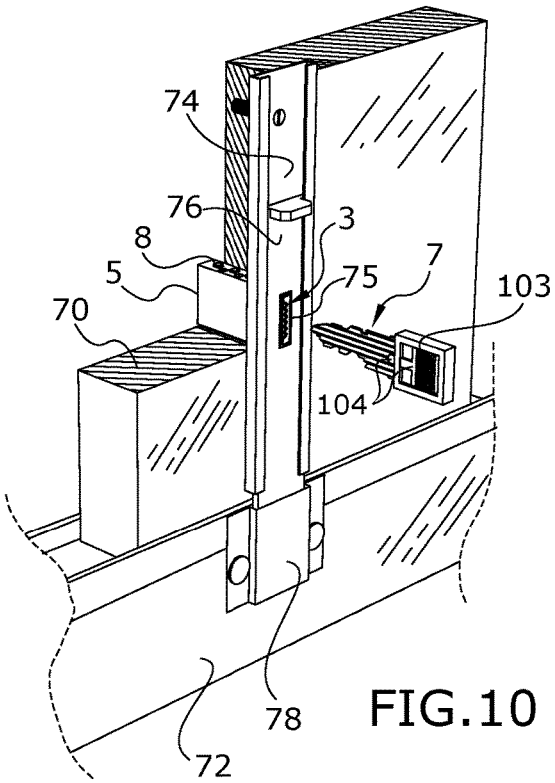
FIG. 10 is a schematic view of another exemplary implementation of the invention applied to the locking of sliding doors.

It has been shown schematically in FIG. 10, another alternative implementation of the present invention in which a sash 70, for example supporting a glazed window, is slidably mounted relative to an embrasure 72. The sash 70 is equipped with a closure device consisting of a slide 74 perpendicular to its direction of movement in which a flat bolt 76 is mounted so as to slide so that it is able to occupy two positions, namely, a closed position in which one of its ends is engaged in a trigger guard 78 and an open position in which said end is disengaged from this trigger guard. The slider 74 is pierced with an opening which gives access to the inlet orifice of a receiving block 5. Furthermore, the bolt 7 is also pierced with an opening 75 of the same dimensions as those of the preceding one and is arranged in such a way that, in the closed position, as shown in FIG. 10, these two openings face each other. Thus, when the window is in the closed position and therefore the bolt 7 is inside the trigger guard 78, the user can enter through the openings a locking block 3 equipped with its control key 7.

Thus, once the locking block 3 has been inserted into the receiving block 5 and the key 7 removed, the bolt 76 is blocked against any translational movement by the simple presence of the locking block 3, so that the sash 70 is then in the locked position and that in this embodiment it is the locking block 3 itself which constitutes the locking means of the security locking system according to the invention. Of course, the unlocking operation is carried out as described above.

The locking system according to the invention can also be used in the field of computing to ensure, for example, the security of a portable computer and prevent third parties from gaining access to the contents thereof and, on the other hand, to ensure the security of the computer itself.

Figure 11A:
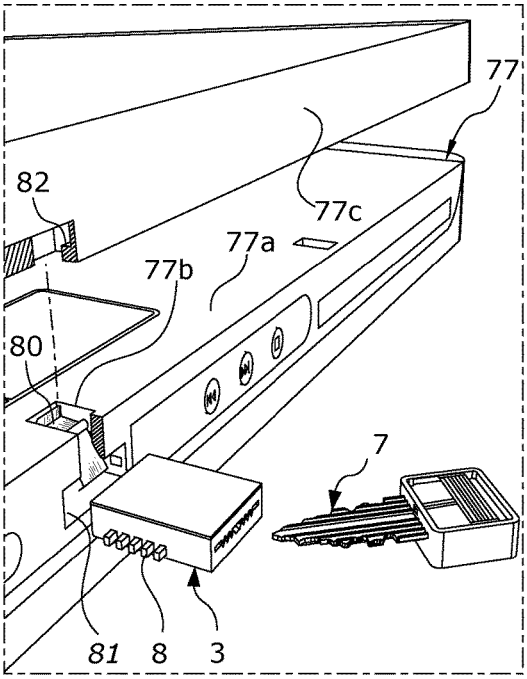
FIGS. 11*a* to 11*d* are schematic views of another exemplary implementation of the invention applied to the security of computers.
Figure 11B:
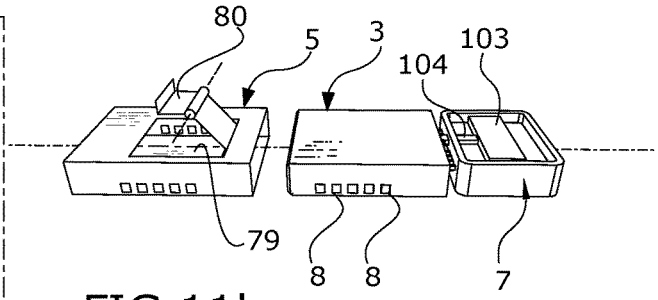
Figure 11C:
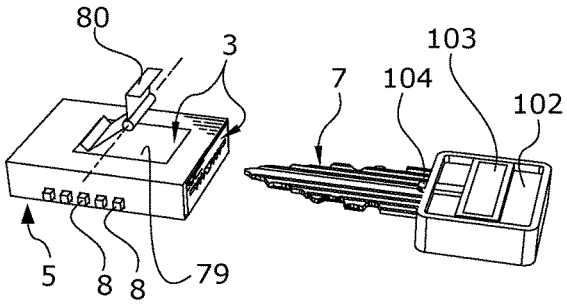

FIGS. 11*a* to 11*d* show an example of such an application of the present invention. A receiving block 5 is produced which takes place in a computer 77 of the portable type and which opens on the outside by an opening 81 of the same dimensions as the sockets referred to as USB Sockets and which is intended to receive a locking block 3 of appropriate dimensions. The receiving block 5 comprises a window 79 on one of its lateral faces which passes a locking member comprising a pivoting latch 80 in the form of a hook which is able to occupy two main positions, namely an open position as well as shown in FIG. 11*b* and a closed position as shown in FIG. 11*e*. The mechanism of the lock 80 is such that when the locking block 3 is not inserted into the receiving block 5 the lock is open (FIG. 11*b*). When the locking block 3 is inserted into the receiving block 5, the locking block 3 pushes the mechanism of the lock 80, which causes the latter to pass in the closed position (FIG. 11*e*). The upper plate 77*a* of the computer comprises a window 77*b* which is located at the right of the lock 80 and by which a hook 82 of the cover 77*c* is admitted when the latter passes into the closed position. This hook 82 cooperates with the lock 80 which ensures its retaining when it passes into the closed position.

The receiving block 5 being secured to the computer, the establishment of the locking block 3 in the receiving block 5 maintains the cover 77*c*, and the removal of the key 7 of the locking block 3 ensures the output of the pistons 8 and maintaining the locking block 3.

Figure 11D:
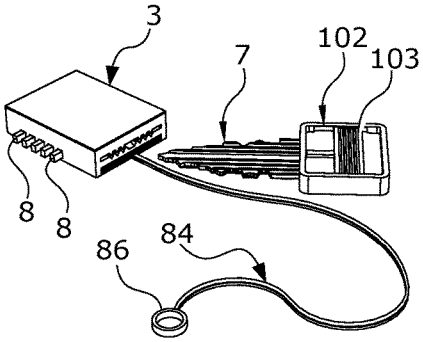

Such an arrangement prevents unauthorized use of the computer. Furthermore, as shown in FIG. 11*d*, if the locking block 3 is provided with a flexible connecting element 84 made of a mechanically strong material, the locking block 3 can be fixed, by any suitable means, the free end thereof to a fixed part 86 ensuring the security of the computer itself As shown on FIG. 12, the security locking system according to the invention can also be used for locking a conventional type door lock, which comprises a sliding bolt 88 which is biased by a spring 89 for into a striker, not shown in the drawing. The removal of the bolt 88 is achieved by a mechanism actuated by a shaft 90 controlled by a handle not shown in the drawing.

Figure 12:
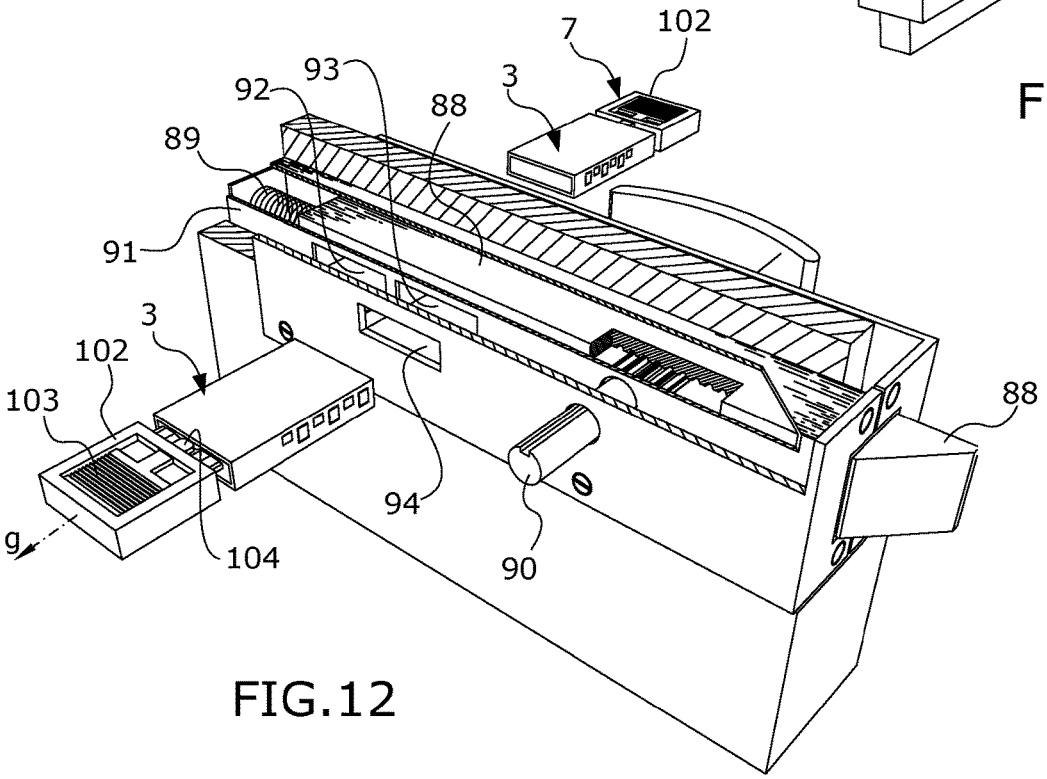
FIG. 12 is a schematic view of another exemplary implementation of the invention applied to a door lock of the conventional type.

The sliding bolt 88 is pierced with two rectangular openings 92 and 93, the cross-section of which is of the same shape and dimensions as that of a locking block 3. The casing 91 of the lock is closed which is pierced with two windows 94 which are arranged respectively opposite the lights 92 and 93 of the bolt 88, these lights being arranged on either side of the lock, allowing users to lock the lock on either side of the door on which it is mounted, as well as shown in FIG. 12.

When an user wishes to lock the lock, he introduces through one of the windows 94 a locking block 3 in one of the lights 92 or 93, depending on the side of the door where it is located, thus blocking any movement of the sliding bolt 88 and ensures its locking by removing its key 7 as well as in the previous example it is the locking block 3 itself which constitutes the locking means of the security locking system according to the invention.

Figure 13:
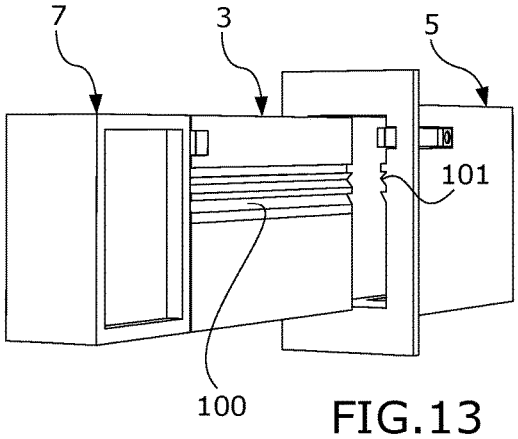
FIG. 13 is a schematic perspective view of an alternative embodiment of a customizable embodiment of a locking block and of a receiving block according to the invention.

Unlocking is carried out as described above. In a variant embodiment of the invention, and as shown in FIG. 13, the locking system can be customized by giving one or both lateral faces of the locking block 3 a specific profile 100 and to the internal face or faces opposite the receiving block 5 a complementary profile 101. Such mode of implementation thus allows the receiving block to receive only locking blocks that are consistent therewith.

Of course, according to the invention, in order to remove the key from the locking block while the pistons are in the retracted position, it is possible to use different means from those described above. Thus, as shown in FIGS. 11 and 12, the head 102 of the key 7 can admit a slide element 103, the front part of which is provided with a tongue, the end 104 of which protrudes from the head. Thus, when it is desired to extract the key 7 from the locking block 3 in order to disengage the pistons 8 and ensure locking, the slide 103 is pushed towards the front of the key and the end 104 thereof then bears on the locking block 3, thereby pushing the key in the direction of the arrow G and allowing it to be removed. Then, as explained above, the pistons are in the extended position and block the removal of the locking block with the receiving block.

The invention claimed is:

1. A security locking system, comprising:

a cylinder provided with a set of pistons that are configured to be positioned by elastic means on an impression formed in an edge of a control key perpendicularly to a direction in which the key is introduced into the cylinder, the set of pistons being configured to take up two positions; a position retracted into the cylinder when the key is introduced into a latter and an extended position when the key is withdrawn therefrom, wherein the cylinder is made up of a locking block of a parallelepiped shape that is configured to be received in a receiving block, and wherein the receiving block further comprises a spring blade configured of securing the locking block once the locking block is placed in the receiving block, wherein the spring blade is fixed at one ends of the receiving block and which is folded at other end to form a hook placed in a notch of the locking block; and locking means which are activated when the locking block is introduced into the receiving block, wherein an upper part and a lower part of each of the pistons respectively is configured in recesses made in an upper guide plate and an lower guide plate which are respectively arranged in an upper part and an lower part of the locking block, and wherein the locking block comprises openings to allow ends of the pistons to leave the locking block when the key is not engaged therein.

2. The security locking system according to claim 1, wherein the locking block comprises means for maintaining that are able to block it in the receiving block when the pistons are in the retracted position, such that the pistons move to the outer position during the extraction of the key from the locking block.

3. The security locking system according to claim 2, wherein the means for maintaining comprises a blade spring whose one end is fixed on the receiving block and the other end comprises a hook adapted to cooperate with a notch of the locking block to maintain the latter with the receiving block.

4. The security locking system according to claim 3, wherein the key is provided with means adapted, by a slight rotation, to release the locking block from the means for maintaining.

5. The security locking system according to claim 4, wherein the key is provided with a pin adapted, during said slight rotation, to push the hook so as to release the locking block.

6. The security locking system according to claim 1, wherein the receiving block is of parallelepiped shape that is configured to receiving the locking block.

7. The security locking system according to claim 1, wherein the locking block comprises a guide and a control block comprising an inlet duct of the key of which at least one of the side walls is of a complementary shape to at least one of lateral flanks of the key.

8. The security locking system according to claim 4, wherein a length (L) of the intake duct is at least equal to half the height (H) of the at least one of the lateral flanks.

9. The security locking system according to claim 8, wherein the key is provided with a head inside which is mounted a slide, a portion protruding from the head on its front, so as to be able to be supported on the locking block when engaged in the latter.

10. The security locking system according to claim 1, wherein the locking means are constituted by the locking block itself.

11. The security locking system according to claim 1, wherein a body of a padlock constitutes the receiving block is configured to receive the locking block.

12. The security locking system according to claim 1, wherein the receiving block is integral with a body of a computer is configured to receive the locking block.

13. The security locking system according to claim 1, wherein at least one of a plurality of lateral faces of the locking block has a specific shape profile, and an inner face of the receiving block has a profile of complementary shape.

14. A method, comprising:

providing a security locking system, the security locking system comprising:

a cylinder provided with a set of pistons that are configured to be positioned by elastic means on an impression formed in an edge of a control key perpendicularly to a direction in which the key is introduced into the cylinder, the set of pistons being configured to take up two positions: a position retracted into the cylinder when the key is introduced into the cylinder and an extended position when the key is withdrawn therefrom, wherein the cylinder is made up of a locking block of a parallelepiped shape that is configured to be received in a receiving block, and wherein the receiving block further comprises a spring blade configured of securing the locking block once the locking block is placed in the receiving block , wherein the spring blade is fixed at one ends of the receiving block and which is folded at other end to form a hook placed in a notch of the locking block; and locking means which are activated when the locking block is introduced into the receiving block, wherein an upper part and a lower part of each of the pistons respectively is configured in recesses made in an upper guide plate and an lower guide plate which are respectively arranged in an upper part and an lower part of the locking block, and wherein the locking block comprises openings to allow ends of the pistons to leave the locking block when the key is not engaged therein.

* * * * *